United States Patent [19]

Coccolo

[11] Patent Number: 4,986,484

[45] Date of Patent: Jan. 22, 1991

[54] METHOD TO STORE FILIFORM PRODUCTS AND RELATIVE DEVICE TO STORE FILIFORM PRODUCTS

[75] Inventor: Enzo Coccolo, Gorizia, Italy

[73] Assignee: Casagrande SpA, Fontanafredda, Italy

[21] Appl. No.: 431,098

[22] Filed: Nov. 3, 1989

[30] Foreign Application Priority Data

Nov. 16, 1988 [IT] Italy ..... 83518 A/88

[51] Int. Cl.[5] ..... B65H 51/20

[52] U.S. Cl. ..... 242/47.01; 242/47.12

[58] Field of Search ..... 242/47.01, 47.12, 25 R, 242/47, 47.09

[56] References Cited

U.S. PATENT DOCUMENTS

| | | | |
|---|---|---|---|
| 2,755,916 | 7/1956 | McIlvried et al. | 242/47.12 |
| 3,078,055 | 2/1963 | Harris | 242/47.12 |
| 3,099,412 | 7/1963 | Nystrom | 242/47.01 |
| 3,241,780 | 3/1966 | Kitselman | 242/47.12 |
| 4,641,794 | 2/1987 | Yamazaki et al. | 242/47.01 |

FOREIGN PATENT DOCUMENTS

| | | | |
|---|---|---|---|
| 0096833 | 12/1983 | European Pat. Off. | 242/47.01 |
| 857512 | 4/1940 | France | 242/47.09 |

*Primary Examiner*—Stanley N. Gilreath
*Attorney, Agent, or Firm*—Nixon & Vanderhye

[57] ABSTRACT

Apparatus and methods for winding an element on a pair of rotatable axially aligned drums and discharging the element therefrom between an element supply and an element processing unit. A pair of switch stations are located such that the element received from its supply and being discharged to the processing unit lie in axial alignment. The first station discharges the element onto a freely rotatable drum mounted on a rotatable element. A second axially spaced, freely rotatable drum is mounted on the element for discharging the element to the second station. Between the drums and carried for rotation with the member are a receipt and delivery station carrying a pair of rollers, respectively, overlying the first and second drums. The first and second stations are movable in an axial direction away from one another when the device winds more of the element onto the drums than discharge therefrom and are movable toward one another when the drums discharge more of the element therefrom than being wound thereon.

11 Claims, 1 Drawing Sheet

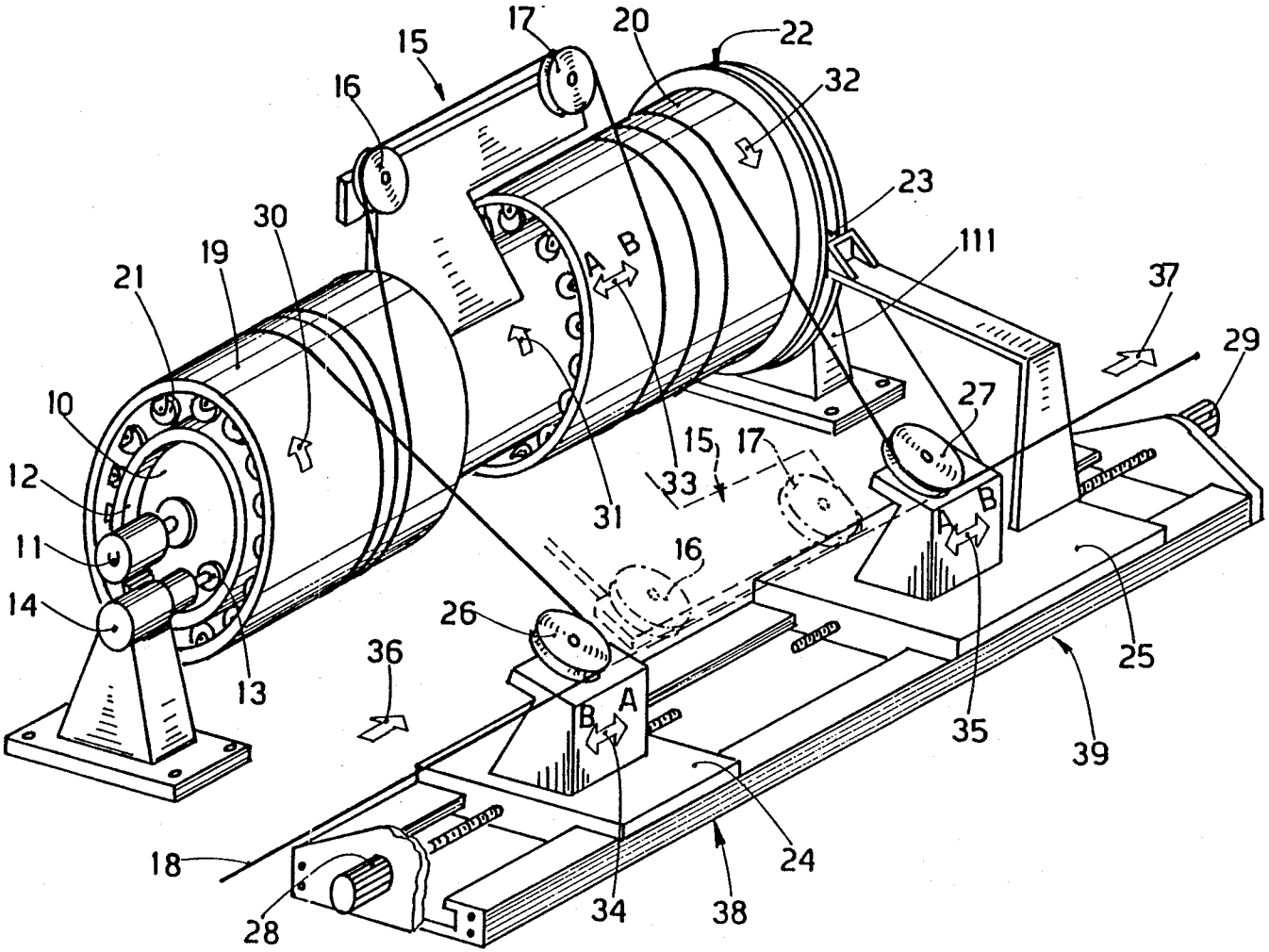
29
37
25
39
111
27
35
23
32
22
24
38
17
15
33
16
20
34
31
17
26
15
36
16
30
28
19
13
21
18
10
12
11
14

METHOD TO STORE FILIFORM PRODUCTS AND RELATIVE DEVICE TO STORE FILIFORM PRODUCTS

FIELD OF THE INVENTION

This invention concerns a storage method and a relative storage device for filiform products which may have a round or polygonal section.

DISCUSSION OF THE PRIOR ART

The invention can be applied to filiform products formed as one single body such as drawn, extruded and rolled products, for instance. It can also be applied to compounded filiform products such as braided items, string, threads, films, etc.

It is therefore applied in the rolling, drawing, extrusion and production or use of cables, strands, films, thin films, etc.

It is employed in the continuous processing of the above products where the processes feed the materials from reels and unite the materials thus fed head-to-tail.

More generally, it is applied in particular where it is not desired that a filiform product such as those mentioned above and also a like or allied product when wound on a storage drum should undergo one or more twists while being unwound.

The invention is applied specifically in the event of transient storage of filiform elements between a feeder unit and a usage unit when processing of the filiform element is in progress downstream of the storage drum.

All the known storage drums entail the shortcoming that, when the filiform element stored thereon is unwound, auxiliary twists which are not always acceptable are produced therein.

These auxiliary twists are not produced only when the winding and unwinding of the filiform element take place in a direction at a right angle to the axis of the drum and substantially at a tangent to the drum.

For instance, in the case of the drums of a crane hoist, the problem of application of the auxiliary twists is not involved.

Such drums of the type employed in a crane hoist, however, do not enable the filiform element to be stored where this element has to be fed continuously and at the same time delivered continuously to the usage means.

So as to be able to create a transient storage while the product is being continuously fed and at the same time has to be continuously delivered, a rotary drum is provided which receives the filiform product substantially at a tangent.

An unwinding means able to rotate about the axis of the drum cooperates with the rotary drum and delivers the filiform product to a switch means located substantially in prolongation of the axis of the drum, but this system imparts twists to the filiform product and is therefore not acceptable.

SUMMARY OF THE INVENTION

The present applicant has designed and tested this invention so as to obviate the above shortcoming and to be able to store and to deliver continuously at the same time a filiform product without imparting thereto unacceptable auxiliary twists.

According to the invention two coaxial idler drums having storage functions are provided.

Between the two drums is included a station to receive and deliver a filiform product which is rotated in a controlled manner about the axis of the two drums.

The second drum, which is the second drum to receive the material to be stored, is able to move axially, and its axial displacement is coordinated with the transverse width of the storage area of the filiform element.

Means to feed the filiform element in coils placed side by side are included in cooperation with the first drum.

By means of this device the filiform product is drawn and wound on the first and second drums of the storage device.

As the two drums are freely rotatable and the receipt and delivery station can rotate, the filiform element can continue to run without stopping.

The tangential speed of the two drums is correlated to the speed of receipt and speed of delivery respectively of the filiform element even if the two drums rotate in opposite directions.

The speed of rotation of the receipt and delivery station is coordinated with the speed of delivery and the need for storage of the filiform element. This means that during the storage phase the receipt and delivery station rotates at an angular speed higher than that of the drums.

During the delivery phase, with the stored value of the filiform element maintained, the angular speeds of the drums and of the receipt and delivery station will be substantially the same as each other.

During the delivery phase, with the employment of the stored stock of the filiform element, the angular speed of the receipt and delivery station will be lower than that of the stored stock or will be halted and will rotate in reverse.

BRIEF DESCRIPTION OF THE DRAWING

Let us now see a preferred embodiment of the invention with the help of the attached FIGURE, which is given as a non-restrictive example.

The single FIGURE of the drawing is a perspective view of an embodiment according to the invention. In the figure a powered drum 10 is upheld on supports 11–111 and comprises a toothed ring 12 at one end; this toothed ring 12 cooperates with a gear wheel 13 driven by a motor 14.

A receipt and delivery station 15 comprising a receiving roller 16 and transmission roller 17 is located on the powered drum 10 in a substantially central lengthwise position.

In this example the transmission roller 17 is secured to the receipt roller 16 and is positioned lengthwise towards the relative end of the powered drum 10.

At each of the two sides of the receipt and delivery station 15 is included a specific storage drum free to rotate idly on the powered drum 10, namely a first storage drum 19 and a second storage drum 20.

The first and second storage drums 19–20 can move on the powered drum 10 by means of wheels 21 able to run on the same, for instance.

In this example the first storage drum 19 is set in cooperation with the receiving roller 16 of the receipt and delivery station 15 and is able only to rotate freely.

Instead, the second storage drum 20 is set in cooperation with the transmission roller 17, which extends lengthwise along the second storage drum 20.

The second storage drum 20 can rotate freely on the powered drum 10 and can move lengthwise therealong.

The lengthwise movement of the second storage drum 20 along the powered drum 10 is actuated and controlled.

At least one delivery switch station 38 cooperates with the first storage drum 19, while a receiving switch station 39 also cooperates with the second storage drum 20.

The two switch stations 38–39 can run, in this example, parallel to the axis of the powered drum 10 and are moved by respective motors 28 and 29.

The delivery switch station 38 is equipped with a first switch roller 26, while the receiving switch station 39 is equipped with a second switch roller 27.

The switch stations 38–39 also comprise respective first and second carriages 24 and 25. The second carriage 25 of the receiving switch station 39 bears also a support of a traversing roller 23; when the second carriage 25 is moved, the traversing roller 23 is displaced thereon.

The traversing roller 23 cooperates with a guide ring 22 included on the circumference of one end of the second storage drum 20.

Thus, the movement carried out by the second carriage 25 parallel to the axis of the powered drum 10 causes the second storage drum 20 to carry out an equal lengthwise movement on the powered drum 10.

It should be borne in mind that the first switch roller 26, receiving roller 16, transmission roller 17 and second switch roller 27 occupy a geometric position whereby a filiform element 18 can arrive from a feeder unit upstream of the first switch roller 26 and reach a usage unit downstream of the second switch roller 27 by passing at a tangent to all the four rollers 26, 16, 17 and 27 without being switched.

The geometric arrangement of these four rollers 26, 16, 17 and 27 is also such that, if the powered drum 10 is rotated to align rollers 16 and 17 between rollers 26 and 27, for example, upon starting the device, the filiform element 18 will pass at a tangent to the aligned rollers 26-16-17-27 without being switched onto the receiving and discharge drums 19 and 20, respectively and will remain, slidingly anchored to and in the grooves of the rollers 26-16-17-27.

When the receipt and delivery station 15 has carried out a part of a rotation of 360°, the filiform element 18, which also possesses its own movement of feed 36, begins to be wound on the first 19 and second 20 storage drums. It is wound on the first storage drum 19 in the tract between the first switch roller 26 and the receipt roller 16 and on the second storage drum 20 in the tract between the transmission roller 17 and the second switch roller 27.

It is obvious that the embodiment shown depends on the geometric design features.

In fact, it is possible to make the receipt and delivery station 15 able to move on the powered drum 10, for instance.

It is also possible to make the receipt roller 16 and transmission roller 17 able to move in relation to each other along the powered drum 10.

It is also possible to make the second switch roller 27 stationary.

These and other variants of the design are all possible.

Let us now see the method of working in the case of the embodiment shown as an example in the attached figure.

A filiform element 18 arrives with the direction of the arrow 36 and at a speed at the first switch roller 26, which at the start of working is located in the neighbourhood of the edge closest to the receipt and delivery station 15 of the first storage drum 19.

The receipt and delivery station 15 and therefore the powered drum 10 rotate at a speed in the direction of the arrow 31.

The filiform element 18 is switched by the first switch roller 26, is wound on the first storage drum 19, rotates about the receiving roller 16 and then about the transmission roller 17 and is then wound on the second storage drum 20 and, leaving the latter, is wound about the second switch roller 27 before proceeding to a usage means.

If the powered drum 10 and therefore the receipt and delivery station 15 continue rotating in the direction of the arrow 31, stored deposits of filiform element 18 will form on the first and second storage drums 19–20. With the powered drum 10 rotating in the direction 31 and the filiform element running in the direction of the arrows 36–37, the first storage drum 19 rotates according to the arrow 30 in a direction concordant with the direction 31, whereas the second storage drum 20 rotates according to the arrow 32 in a direction discordant with the direction 31.

When the powered drum 10 is rotated, the delivery switch station 38 and receipt switch station 39 have to move in the direction 34B and in the direction 35B respectively. This lateral displacement of the two switch stations 38–39 enables the filiform element 18 to be wound on the storage drums 19–20 at a correct pitch.

If the powered drum 10 is halted, the filiform element 18 then begins to take up the stock stored on the storage drums 19–20, while the two switch stations 38–39 have to move in the directions 34A and 35A respectively to take up correctly the filiform element 18 stored on the storage drums 19–20.

When the receiving switch station 39 moves according to the arrow 35A, the second storage drum 20 also moves axially with an equal concordant motion 33A, whereas when the receiving switch station 39 moves according to the arrow 35B, the second storage drum 20 moves with an equal concordant motion 33B.

I claim:

1. A device for temporarily storing a filiform element received in transient from an upstream supply thereof for transmittal to a downstream processing unit, comprising:

a frame;

a first idler storage drum carried by said frame for rotation about an axis and for receiving the element;

a second idler storage drum carried by said frame at a location axially spaced from said first drum for rotation about said axis and for discharging the element;

a receipt and delivery station carried by said frame between said drums and mounted for rotation about said axis, said receipt and delivery station having at least one roller for transferring the element from said first drum to said second drum;

first and second switch stations for transmitting the element from the supply to the first drum and from the discharge drum to the downstream processing unit, respectively; and means for displacing said second drum in an axial direction relative to said first drum.

2. A device according to claim 1 including a common rotatable member mounting said receipt and delivery station and said first and second drums, means for rotating said common member, said first and second storage drums being rotatable freely on said common member.

3. A device according to claim 2 wherein said common member mounts said receipt and delivery station for rotation therewith, a second roller carried by said receipt and delivery station, said one roller overlying an inner edge of said first storage drum and said second roller overlying said second storage drum.

4. A device according to claim 2 wherein said common member mounts said receipt and delivery station for rotation therewith, a second roller carried by said receipt and delivery station, said one roller overlying an inner edge of said first storage drum and said second roller overlying said second storage drum, including first and second carriages carried by said first and second switch stations, respectively, and movable alongside of and in a direction parallel to said axis, means for moving said first carriage in said axial direction to maintain a predetermined pitch of the element when wound on said first drum, means for moving said second carriage in said axial direction concomitantly with the axial movement of said second rum and in like axial directions.

5. A device according to claim 1 including a first carriage carrying said first switch station and movable along side of and in a direction parallel to the axis of rotation of said first drum, and means for moving said first carriage in said axial direction to maintain a predetermined pitch of the element when wound on said first drum.

6. A device according to claim 1 including a second carriage carrying said second switch station and movable along side of and in a direction parallel to the axis of rotation of said second drum, and means for moving said second carriage in said axial direction concomitantly with the axial movement of said second drum and in like axial directions to maintain a predetermined pitch of the element on said second drum.

7. A device according to claim 6 wherein said second carriage moving means includes a guide ring carried along an edge of said second drum, means carried by said second switch station and engageable with said edge for moving said second drum with said second carriage in said like axial directions.

8. A device according to claim 7 wherein said carriages, said receipt and delivery station, and said drums are arranged such that, upon rotation of said receipt and delivery station, said carriages are movable in opposite axial directions away from one another and said drums are rotatable in opposite directions to enable winding more of the element on said drums than discharged therefrom and, upon halting rotation of said receipt and delivery stations, said carriages are movable in opposite axial directions toward one another with said drums continuing to be rotatable in said opposite directions to enable discharging more of the element from the drums than wound thereon.

9. A method for temporarily storing a filoform element in transit between a supply thereof and a processing unit therefor on a pair of axial spaced and aligned first and second drums, comprising the steps of:

feeding the element from a supply thereof about a first switch means;

winding the element from said first switch means onto said first drum, transferring the element from said first drum to said second drum by passing the element over at least one roller;

winding the element on the second drum, unwinding the element from said second drum and about a second switch means for delivery to a processing unit; and displacing one of said drums toward and away from the other of said drums in response to winding more of the element on said drums than discharged therefrom and discharging more of the element from the drums than wound thereon, respectively.

10. A method according to claim 9 including moving said switch stations in opposite axial directions away from one another to enable winding more of the element on said drums than discharged therefrom and moving said stations in opposite directions toward one another to enable discharge of more of the element from the drums than being wound thereon.

11. A method according to claim 9 including rotating said drums in the same opposite directions when winding or discharging more of the element onto or from the drums, respectively.

* * * * *